US006450783B1

(12) United States Patent
Gokan et al.

(10) Patent No.: US 6,450,783 B1
(45) Date of Patent: Sep. 17, 2002

(54) ENGINE WITH OIL PUMP

(75) Inventors: Yoshitsugu Gokan; Yosuke Hoi, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/714,617

(22) Filed: Nov. 17, 2000

(30) Foreign Application Priority Data

Nov. 19, 1999 (JP) ..... 11-329464

(51) Int. Cl.[7] ..... F04B 17/00; B63H 22/34
(52) U.S. Cl. ..... 417/364; 417/359; 440/83
(58) Field of Search ..... 417/364, 359, 417/360, 361; 440/83; 464/157

(56) References Cited

U.S. PATENT DOCUMENTS 4,680,987 A * 7/1987 Morimoto ..... 74/866
5,720,638 A * 2/1998 Hale ..... 440/83
5,730,657 A * 3/1998 Olgren ..... 464/157
5,755,606 A * 5/1998 Takahashi et al. ..... 440/84

FOREIGN PATENT DOCUMENTS

IT 0 376 901 * 7/1990
JP A9301286 11/1997

* cited by examiner

*Primary Examiner*—Charles G. Freay
*Assistant Examiner*—Michael K. Gray
(74) *Attorney, Agent, or Firm*—Birch, Stewart, Kolasch & Birch, LLP

(57) ABSTRACT

An oil pump includes an oil supply pump and an oil recovery pump disposed on an extension line of a crankshaft of an engine. One joint member is provided at an end portion of the crankshaft, and another joint member is provided at an end portion of a pump shaft. The two joint members are coupled to each other on the same axial line within a front cover of an engine. The two joint members have alternating concave portions and convex portions. The convex portions of the two joint members include inclined faces and opposing driving transmission faces. The inclined faces of the convex portions guide the convex portions into the concave portion of the opposing joint member, so that the two joint members are meshed with one another. The crankshaft side joint member is fastened together with an ACG rotor. An oil tank connected to the oil pump is disposed above and very close to the oil pump.

26 Claims, 8 Drawing Sheets

ENGINE WITH OIL PUMP

BACKGROUND OF THE INVENTION

1. Field of the Invention

The present invention relates to an engine having an oil pump. More particularly, the present invention relates to a coupling structure, or a driving transmission structure, between a crankshaft of the engine and a pump shaft of the oil pump.

2. Description of the Background Art

A conventional engine having an oil pump is shown in FIGS. 9 and 10, which are from the official gazette of Japanese Patent Laid-Open No. Hei. 9 301286. The engine 1 shown in FIGS. 9 and 10 is carried on a small-sized boat. The engine 1 includes a supply pump 2 (see FIG. 10) for supplying oil from an oil tank 4 into the engine 1, and a recovery pump 3 for recovering oil, which has lubricated the inside of the engine 1, into the oil tank 4. The pumps 2 and 3 are disposed on shafts 2*a* and 3*a* which extend in parallel to a crankshaft 5 of the engine, and are driven to rotate by the crankshaft 5 through a transmission gear (not shown). Since the pumps 2 and 3 of the engine 1 described above are each respectively disposed on the shafts 2*a*, 3*a* parallel to the crankshaft 5, and are driven to rotate by the crankshaft 5 through the transmission gear (not shown), there is a disadvantage that the driving structure therefor is complicated, and also an increased number of parts are required.

SUMMARY OF THE INVENTION

It is therefore an object of the present invention to provide an engine with an oil pump wherein the oil pump can be driven with a simple structure and also the number of parts is decreased. To attain the object described above, an oil pump is disposed on an extension line of a crankshaft of the engine, and a coupler interconnects the crankshaft to a shaft of the oil pump. The coupler includes a first joint member provided at an end portion of the crankshaft, and a second joint member provided at an end portion of the shaft of the oil pump. The two joint members are coupled to each other on the same axial line within a cover of the engine.

The joining portions of both joint members are formed with concave and convex portions. Faces of the convex portions which oppose driving transmission faces of the convex portions are formed as inclined faces for guiding the convex portions of the opposing joint member. The joint member on the crankshaft is secured by being fastened together with an ACG rotor provided at an end portion of the crankshaft.

Because the oil pump is disposed on an extension line of the crankshaft, and the joint member provided at an end portion of the crankshaft and the joint member provided at an end portion of the pump shaft are coupled to each other on the same axial line, the requirement for a conventionally required transmission gear is eliminated. In the present invention, the oil pump can be driven with a simple structure, and the number of parts can be reduced. Further, since the two joint members are coupled to each other within the cover of the engine, the space for coupling the crankshaft and the pump shaft to each other may be small. However, because the coupler is located within the cover and cannot be visually observed, there is the possibility that the coupling operation may be difficult.

In the present invention, even if the coupling portions of the two joint members are within the cover and cannot be visually observed, the coupling operation can be readily performed since the joining portions of the two joint members are formed with the concave and convex portions, wherein faces of the convex portions which oppose driving transmission faces of the convex portions are formed as inclined faces for guiding the convex portions of the opposing joint member.

As described above, with the present invention, the oil pump can be driven with a simple structure, and the number of parts can be reduced. In addition, while the space for coupling the crankshaft and the pump shaft may be small, the coupling operation of the two joint members can be performed readily. Also, since the joint member of the crankshaft side is secured by being fastened together with the ACG rotor which is provided at an end portion of the crankshaft, the ACG rotor and the joint member can be provided efficiently in a small space with a small number of parts.

An oil tank is connected to the oil pump, and is disposed above and very close to the oil pump. The oil pump includes an oil supply pump and an oil recovery pump which are driven to rotate by a common shaft. Since the oil tank is disposed above and very close to the oil pump, the space above the oil pump can be utilized efficiently, and members around the engine can be compactly configured. In addition, since pipes for connecting the oil pump and the oil tank to each other can be made short, oil can be circulated efficiently.

Since the oil supply pump and the oil recovery pump are rotated by a common shaft, the engine can be compactly formed when compared with an engine of the configuration wherein the oil supply and oil recovery pumps are disposed on individual shafts, and driven to rotate by transmissions as in the conventional engine with an oil pump shown in FIG. 10.

Where the oil supply pump and the oil recovery pump are driven to rotate by the common shaft, although the length of the pump in its axial line direction becomes comparatively large, the space above the oil pump can be utilized effectively by disposing the oil tank above and very close to the oil pump, and members around the engine can be compactly configured. In addition, not only it is possible to make the pipes for connecting the oil pump and the oil tank to each other short to augment the circulation efficiency of oil, but it is also possible to concentrate the pipes for the oil supply pump and the pipe for the oil recovery pump.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
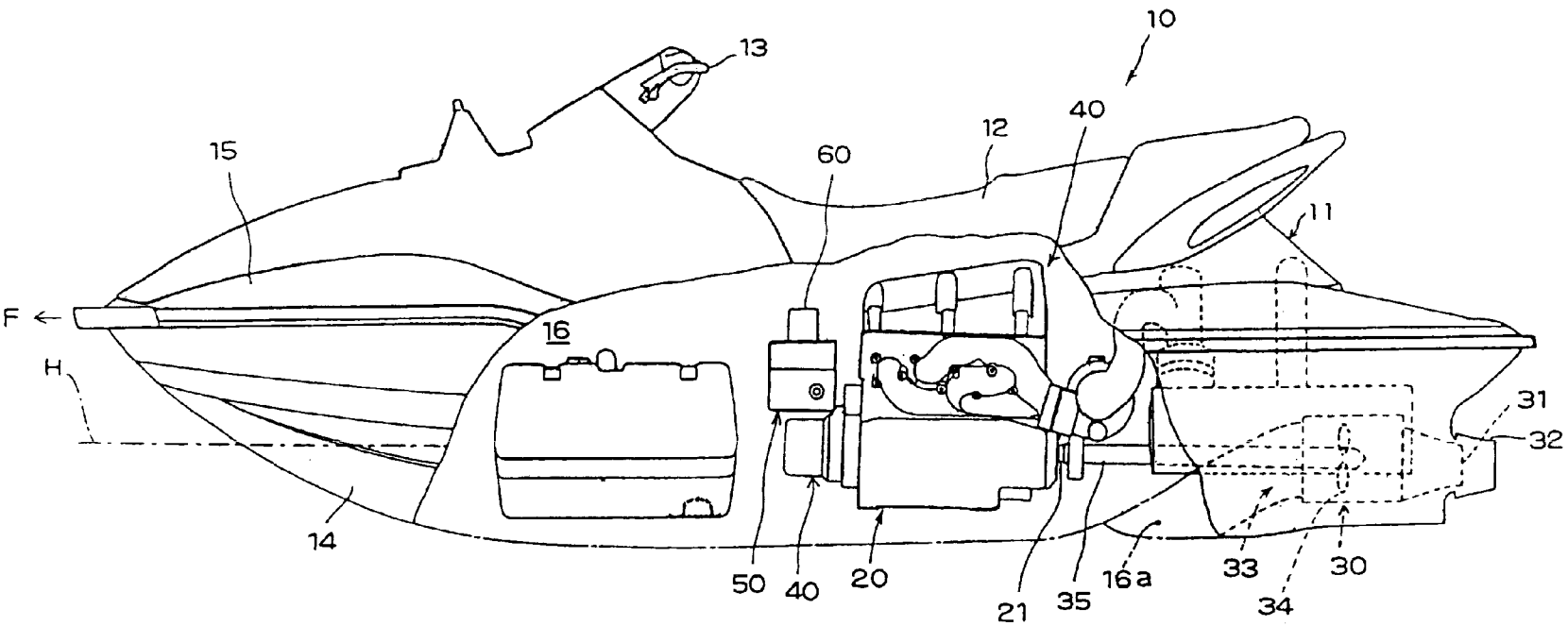
FIG. 1 is a schematic side elevational view, partly broken, showing an example of a saddle type small-sized boat on which an embodiment of an engine with an oil pump according to the present invention is carried.
Figure 2:
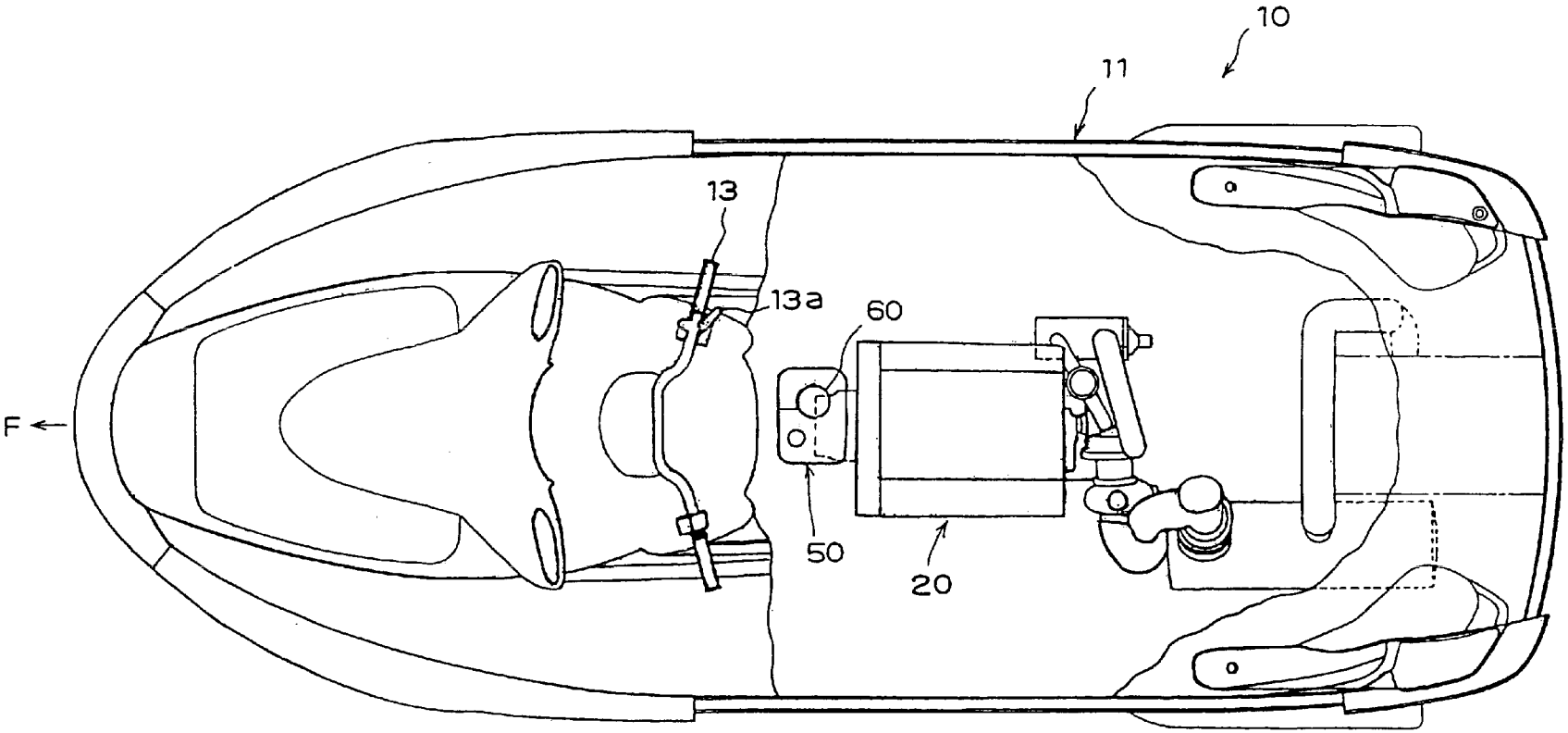
FIG. 2 is a top plan view of the saddle type small-sized boat.

An embodiment of the present invention will now be described with reference to the drawings. As shown in FIGS. 1 and 2, the saddle type small-sized boat 10 can be steered by a steering handle bar 13 with a throttle lever gripped by a passenger seated on a seat 12 on a boat body 11.

The boat body 11 has a floating body structure wherein a lower hull panel 14 and an upper hull panel 15 are joined together with a space 16 formed therebetween. In the space 16, an engine 20 is placed on the lower hull panel 14, and a jet pump 30 serving as propelling means driven by the engine 20 is provided at a rear portion of the lower hull panel 14.

The jet pump 30 has a flow path 33 extending from an intake 16*a* opened to the bottom of the boat to a jet 31 opened to a rear end of the boat body, and a nozzle 32. An impeller 34 is disposed in the flow path 33, and a shaft 35 of the impeller 34 is connected to a rear end of a crankshaft 21 of the engine 20. Accordingly, if the impeller 34 is driven to rotate by the engine 20, then water taken in through the intake 16*a* is jetted from the jet 31 past the nozzle 32, whereby the boat body 11 is propelled. The driving speed of the engine 20, that is, the propelling force by the jet pump 30, is controlled by a revolving operation of a throttle lever 13*a* (refer to FIG. 2) of the steering handle bar 13 described above. The nozzle 32 is associated with the steering handle bar 13 by a control wire (not shown) and is controlled to be turned by an operation of the handle bar 13, whereby the advancing direction can be changed.

Figure 3:
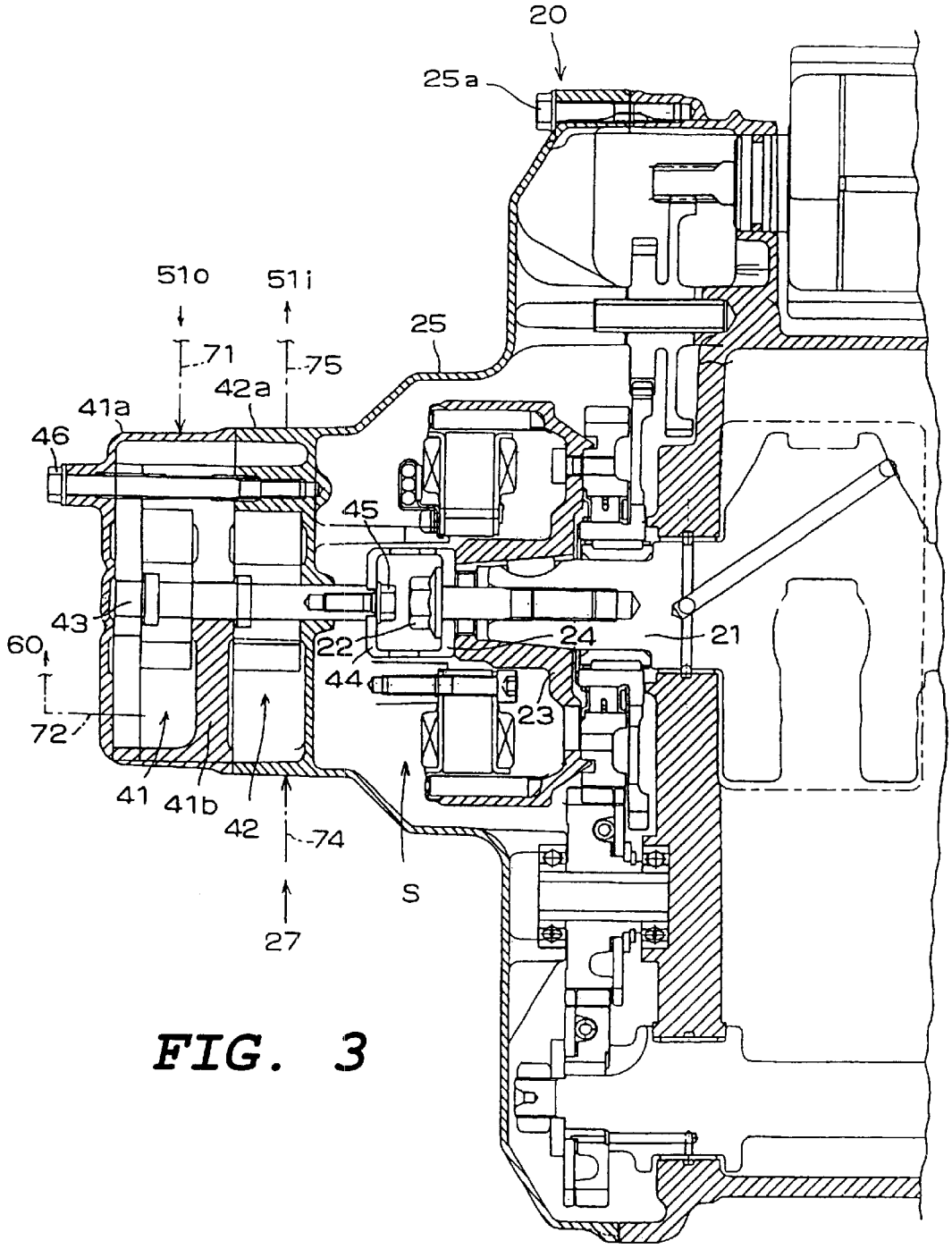
FIG. 3 is a sectional view of a front portion of an engine.
Figure 4:
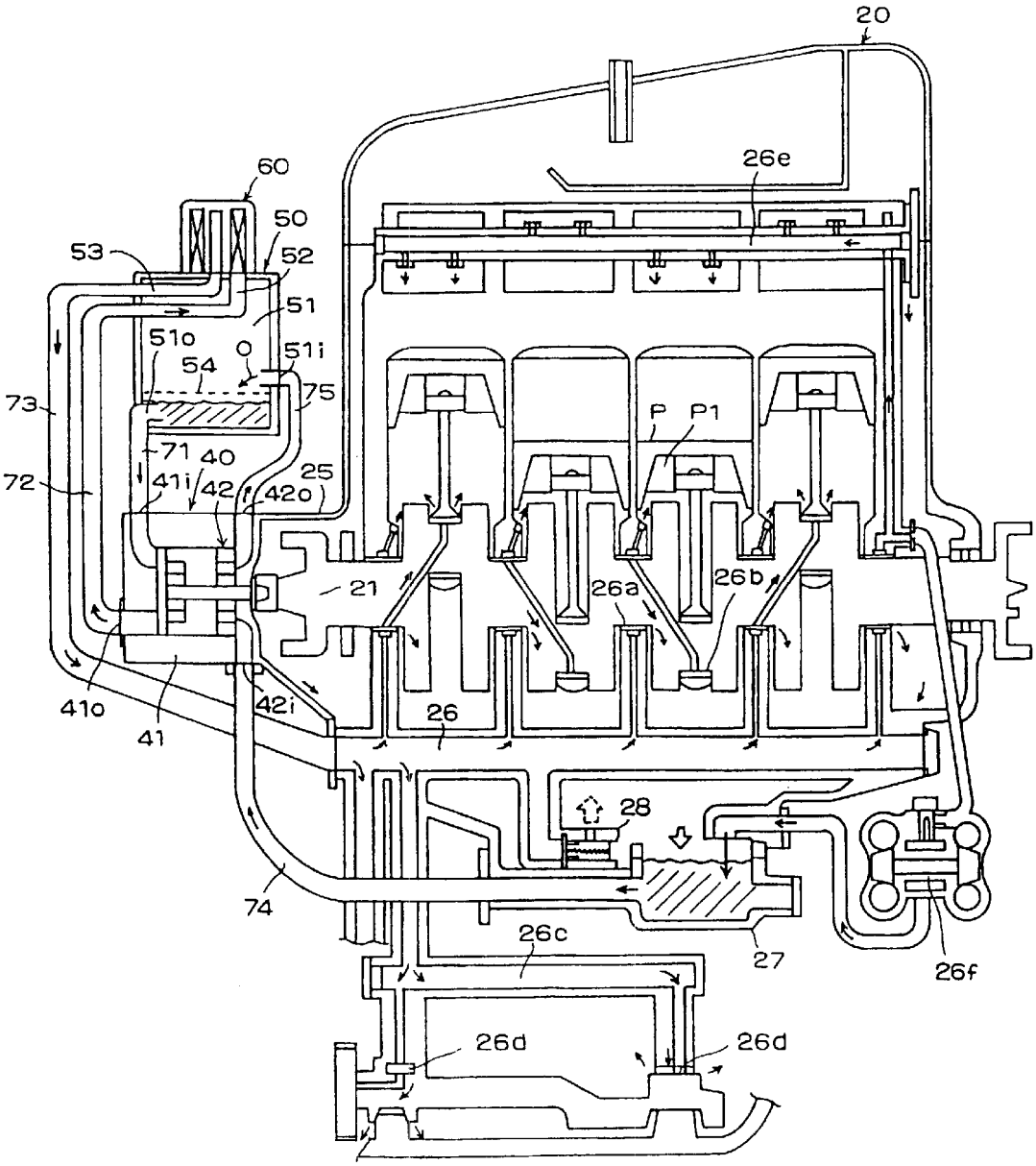
FIG. 4 is a diagram of a circulation route of oil.

Referring now to FIGS. 3 and 4, the engine 20 is a DOHC straight four-cylinder four-cycle engine. An oil pump 40 is disposed on an extension line of the crankshaft 21 at a forward portion of the engine 20 with respect to an advancing direction of the boat body 11. The oil pump 40 includes an oil supply pump 41 and an oil recovery pump 42. The two pumps 41 and 42 are driven to rotate by a common pump shaft 43.

A joint member 44 is secured to a rear end portion of the pump shaft 43 by means of a bolt 45, and another joint member 24 is secured to a front end portion of the crankshaft 21 by means of a bolt 22. The joint member 24 of the crankshaft 21 side is secured by being fastened together with an ACG rotor 23, which is provided at a front end portion of the crankshaft 21, by means of the bolt 22.

Figure 6:
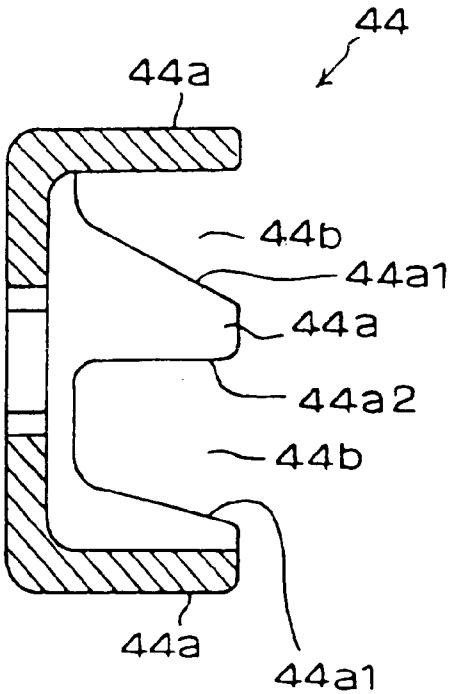
FIG. 6 is a cross-sectional view of the joint member taken along line VI—VI of FIG. 5.
Figure 5:
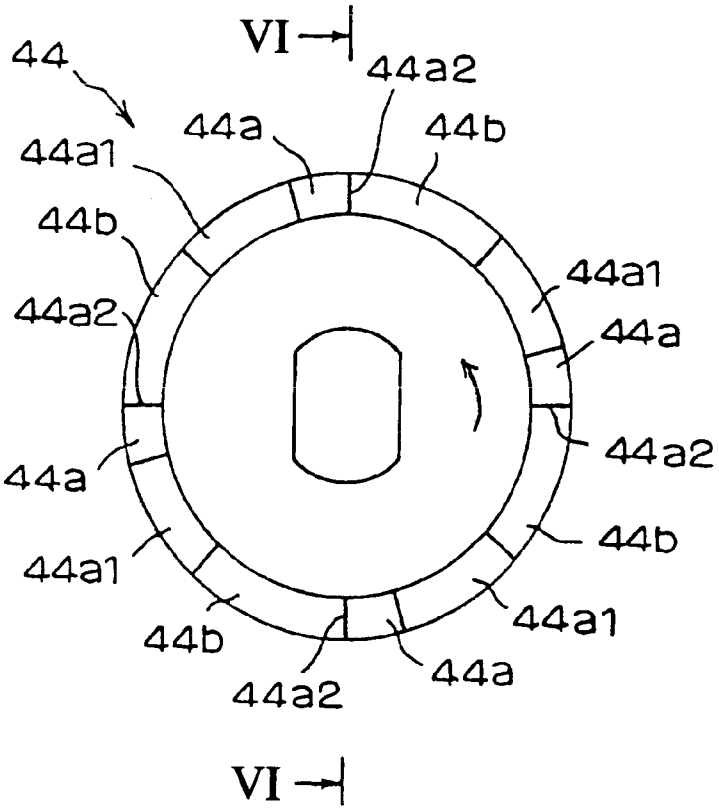
FIG. 5 is a rear elevational view of a joint member mounted on a pump shaft.
Figure 8:
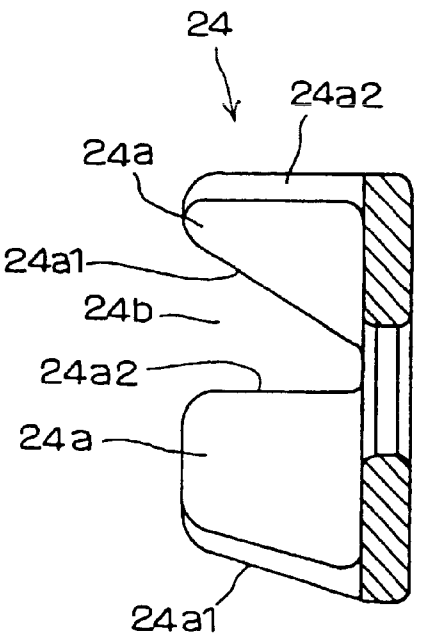
FIG. 8 is a sectional view a joint member mounted on a crankshaft taken along line VIII—VIII of FIG. 7.
Figure 7:
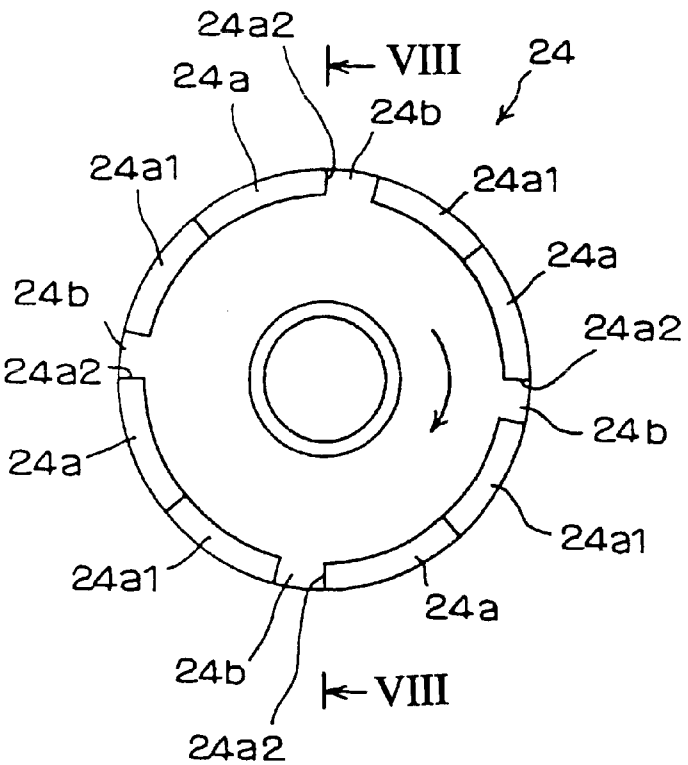
FIG. 7 is a front elevational view of a joint member mounted on a crankshaft.
Figure 9:
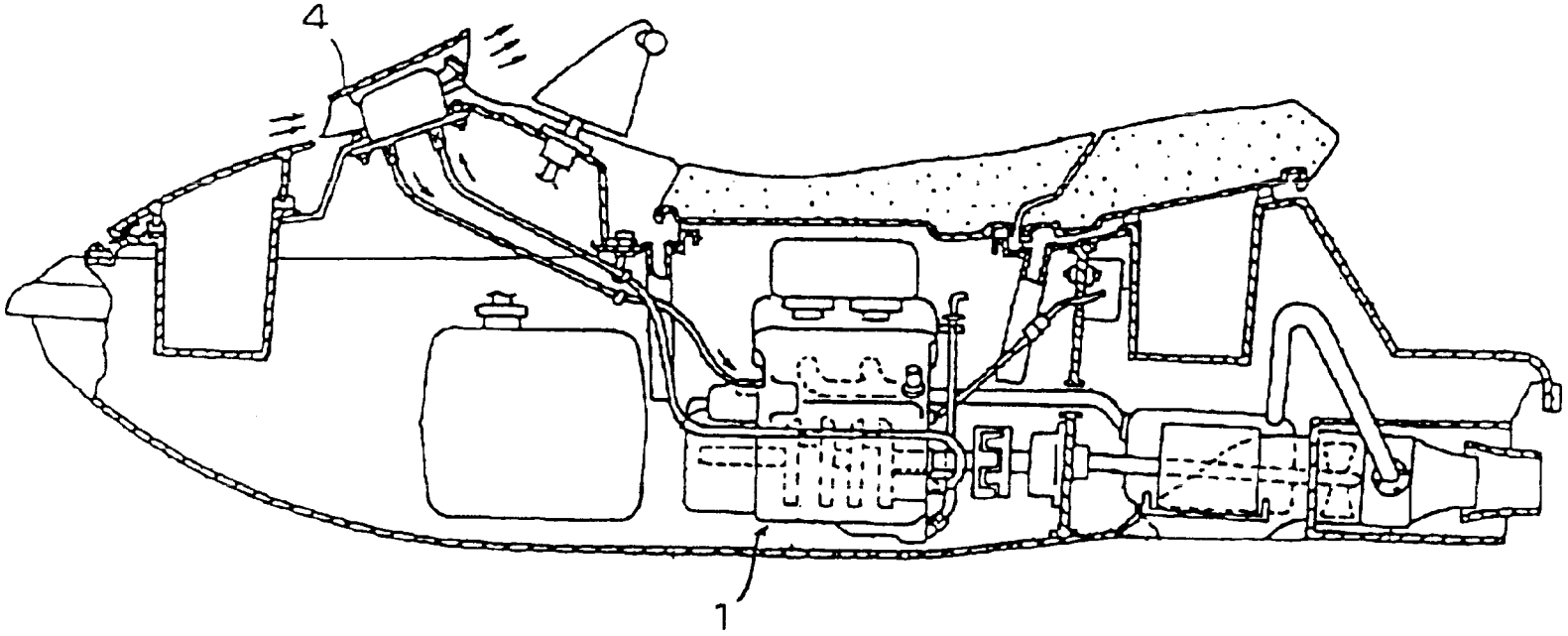
FIG. 9 BACKGROUND ART
FIG. 9 is an explanatory view of the prior art.

Referring now to FIGS. 5 and 6, the joint member 44 mounted on the pump shaft 43 has plural (in the present embodiment, four) convex portions 44*a* and concave portions 44*b* disposed alternately along a circumferential direction thereof. Further, as shown in FIGS. 7 and 8, the joint member 24 mounted on the crankshaft 21 has the same number of convex portions 24*a* and concave portions 24*b* as that of the concave and convex portions of the joint member 44 along a circumferential direction thereof. When the two joint members are coupled to each other on the same axial line, the concave and convex portions of the two joint members mesh and fit with each other. In particular, the convex portions 44*a* of the joint member 44 fit in the concave portions 24*b* of the joint member 24, and the convex portions 24*a* of the joint member 24 fit in the concave portions 44*b* of the joint member 44, respectively.

The joint member 24 of the crankshaft 21 side rotates in the clockwise direction in FIG. 7 as indicated by the arrow in the figure, and the joint member 44 of the pump shaft 43 side is driven to rotate in the counterclockwise direction in FIG. 5 as indicated by the arrow in the figure. Consequently, the two joint members 24 and 44 rotate in the same direction when assembled together. Inclined faces 24*a*1 and 44*a*1 of the convex portions 24*a* and 44*a* oppose driving transmission faces 24*a*2 and 44*a*2, and are formed as inclined faces which guide the convex portions 44*a* and 24*a* of the joint members 44 and 24 to intermesh. It is to be noted that the inclination angle of the inclined faces 24*a*1 and the inclination angle of the inclined faces 44*a*1 are equal to each other.

As shown in FIG. 3, a casing 42*a* of the oil recovery pump 42 is formed integrally with a front cover 25 of the engine 20, and a casing 41*a* of the oil supply pump 41 is secured to the casing 42*a* of the oil recovery pump 42 by a plurality of bolts 46, only one being shown in FIG. 3. An opposing wall 41*b* of the oil supply pump 41 next to the oil recovery pump 42 forms part of the casing of the oil recovery pump 42, and forms a barrier between the oil supply pump 41 and the oil recovery pump 42.

The front cover 25 is secured to a front portion of the engine 20 by a plurality of bolts 25*a*, only one being shown in FIG. 3. When the front cover 25 is secured to the front portion of the engine 20, the joint member 44 of the pump shaft 43 and the joint member 24 of the crankshaft 21 are coupled to each other within the front cover 25.

As shown in FIGS. 1, 2 and 4, an oil tank 50 is disposed above and very close to the oil pump 40. An oil filter 60 is provided on an upper face of the oil tank 50. As shown in FIG. 4, the oil tank 50 has an oil storage portion 51, a supply path 52 formed above the oil storage portion 51 for supplying oil to the oil filter 60, and a discharge path 53 for discharging oil from the oil filter 60.

The oil storage portion 51 has an oil entrance 51*i* and an oil exit 51*o* formed therein. Exit 51*o* is connected to an inlet port 41*i* of the oil supply pump 41 by a pipe 71. A delivery port 41*o* of the oil supply pump 41 is connected to the supply path 52 to the oil filter 60 by a pipe 72. The discharge path 53 from the oil filter 60 is connected to a main gallery 26 of the engine 20 by a pipe 73. Oil supplied from the main gallery 26 to various portions of the engine is recovered into an oil pan 27. The oil pan 27 is connected to an inlet port 42*i* of the oil recovery pump 42 by a pipe 74, and a discharge port 42*o* of the oil recovery pump 42 is connected to the entrance 51*i* of the oil tank 50. Accordingly, a general circulation route of oil is from the oil tank 50, to the oil supply pump 41, then to the oil filter 60, then to the main gallery 26 of the engine 20, then to various portions of the engine, then to the oil pan 27 of the engine 20, then to the oil recovery pump 42, and finally back to the oil tank 50.

Oil routes from the main gallery 26 of the engine 20 include four routes. The first route is a route wherein oil lubricates a bearing portion 26*a* of the crankshaft 21 from the main gallery 26, then lubricates a crank pin, a connecting rod and a connection portion 26*b*, and is jetted to the back P1 of a piston P, whereafter it returns to the oil pan 27. The second route is a route wherein oil lubricates a bearing portion 26*d* of a balancer from the main gallery 26 through a sub gallery 26*c*, and then returns to the oil pan 27. The third route is a route wherein oil flows from the main gallery 26 to a camshaft internal flow path 26*e* to lubricate a cam mechanism for valve motion, and then returns to the oil pan 27. The fourth route is a route wherein oil flows from the main gallery 26 to the turbo charger to lubricate a shaft portion 26*f* of the turbo charger, and returns to the oil pan 27. A relief valve 28 is provided for the main gallery 26.

With the engine and oil pump arrangement having such a configuration as described above, several operation and effects are obtained. Since the oil pump 40 is disposed on an extension line of the crankshaft 21, and the joint member 24 provided at an end portion of the crankshaft 21 and the joint member 44 provided at an end portion of the pump shaft 43 are coupled to each other on the same axial line, the requirement for a conventionally required transmission gear is eliminated. In the present invention, the oil pump 40 can be driven with a simple structure, and the number of parts can be reduced. Further, since the two joint members 24 and 44 are coupled to each other within the cover 25 of the engine 20, the space S (refer to FIG. 3) for coupling the crankshaft 21 and the pump shaft 43 to each other may be small.

Because the two joint members 24 and 44 are coupled to each other within the cover 25 of the engine 20 in this manner and cannot be visually observed, there is the possibility that the coupling operation may be difficult. However, since the joining portions of the two joint members 24 and 44 are formed with concave and convex portions, and since the faces 24*a*1 and 44*a*1 of the convex portions 24*a* and 44*a* which oppose the driving transmission faces of the convex portions 24*a* and 44*a* are formed as inclined faces 24*a*1 and 44*a*1 which guide the convex portions 44*a* and 24*a* to intermesh, even if the coupling portions of the two joint members 24 and 44 are within the cover 25 and cannot be visually observed, the coupling operation can be readily performed.

In the present invention, the oil pump 40 can be driven with a simple structure, and the number of parts can be reduced. In addition, while the space S for coupling the crankshaft 21 and the pump shaft 23 may be small, the coupling operation of the two joint members 24 and 44 can be readily performed.

Since the joint member 24 of the crankshaft 21 side is secured by being fastened together with the ACG rotor 23 which is provided at an end portion of the crankshaft 21, the ACG rotor 23 and the joint member 24 can be provided efficiently in a small space with a small number of parts at an end portion of the crankshaft 21. Because the oil tank 50 connected to the oil pump 40 is disposed above and very close to the oil pump 40, the space above the oil pump 40 can be utilized efficiently, and members around the engine 20 can be compactly arranged. Also, since the pipes 71, 72 and 75 for connecting the oil pump 40 and the oil tank 50 to each other can be made short, oil can be circulated efficiently.

Figure 10:
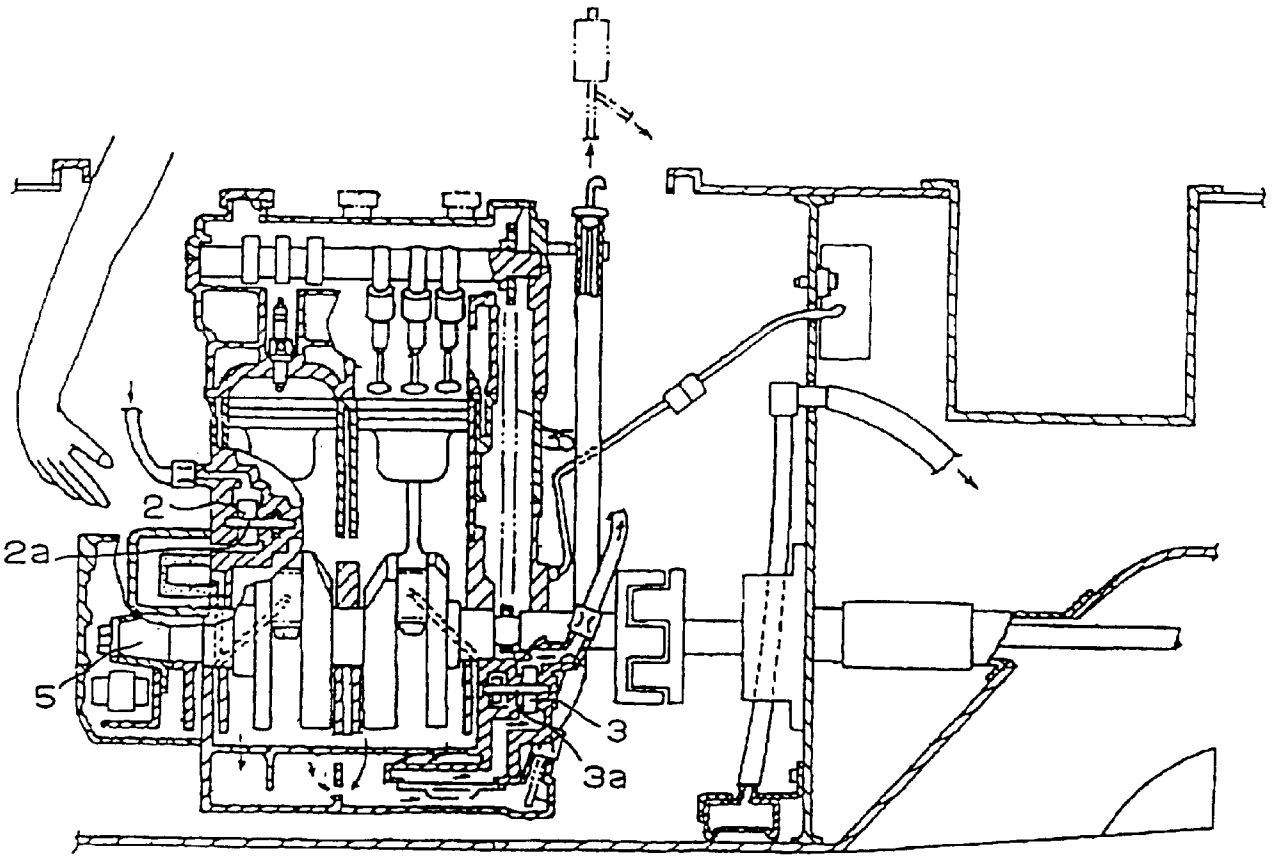
FIG. 10 BACKGROUND ART
FIG. 10 is an explanatory view of the prior art.

Since the oil supply pump 41 and the oil recovery pump 42 of the oil pump 40 are driven to rotate by the same shaft 43, the engine can be compact when compared with an engine configuration wherein the oil pumps 2 and 3 are disposed on individual shafts 2*a* and 3*a* and driven to rotate by transmission systems, as in the conventional engine with an oil pump shown in FIG. 10.

Where the oil supply pump 41 and the oil recovery pump 42 are driven to rotate by the common shaft 43 as in the present invention, although the length of the pump 40 in its axial line direction becomes comparatively large, the space above the oil pump 40 can be utilized effectively by disposing the oil tank 50 above and very close to the oil pump 40, and members around the engine can be compactly configured. In addition, not only it is possible to make the pipes 71, 72 and 75 for connecting the oil pump 40 and the oil tank 50 to each other short to augment the circulation efficiency of oil, but it is also possible to concentrate the pipes 71 and 72 for the oil supply pump 41 and the pipe 75 for the oil recovery pump 42.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An engine with an oil pump comprising:

an oil pump disposed on an extension line of a crankshaft of said engine;

a first joint member provided at an end portion of said crankshaft; and a second joint member provided at an end portion of a shaft of said oil pump, said joint members being coupled to each other on the same axial line within a cover of said engine, wherein the joining portions of both of said first and second joint members are formed with concave and convex portions, and faces of said convex portions are formed as linearly inclined faces for guiding said convex portions of the opposing joint members together, said inclined faces of said convex portions of said first joint member being positioned against said inclined faces of said convex portions of said second joint member.

2. The engine with an oil pump according to claim 1, wherein said first joint member is secured together with a rotor provided at said end portion of said crankshaft.

3. The engine with an oil pump according to claim 1, wherein an oil tank connected to said oil pump is disposed above and very close to said oil pump.

4. The engine with an oil pump according to claim 2, wherein an oil tank connected to said oil pump is disposed above and very close to said oil pump.

5. The engine with an oil pump according to claim 1, wherein said oil pump includes an oil supply pump and an oil recovery pump which are both driven to rotate by said shaft.

6. The engine with an oil pump according to claim 2, wherein said oil pump includes an oil supply pump and an oil recovery pump which are both driven to rotate by said shaft.

7. The engine with an oil pump according to claim 3, wherein said oil pump includes an oil supply pump and an oil recovery pump which are both driven to rotate by said shaft.

8. The engine with an oil pump according to claim 1, wherein each of said convex portions further includes a vertical face opposing said linearly inclined face, said vertical faces of said convex portions of said first joint member being positioned against said vertical faces of said convex portions of said second joint member.

9. An engine with an oil pump comprising:

an engine having a crankshaft;

an oil pump having a pump shaft, said pump shaft and said crankshaft being rotatable about a same axis of rotation; and a coupling device for connecting said crankshaft to said pump shaft, said coupling device including:

a first joint member attached to an end of said crankshaft; and a second joint member attached to an end of said pump shaft, said first joint member and said second joint member each including a plurality of convex portions disposed along a circular line, each of said convex portions including a linearly inclined face and an opposing vertical face, said inclined faces of said convex portions of said first joint member being positioned against said inclined faces of said convex portions of said second joint member, and said vertical faces of said convex portions of said first joint member being positioned against said vertical faces of said convex portions of said second joint member, wherein said first joint member is engaged with said second joint member to transmit rotation from said crankshaft to said pump shaft.

10. The engine with an oil pump according to claim 9, wherein said first joint member includes a plurality of concave portions alternately disposed with said convex portions along a circular line, and said second joint member includes a plurality of convex portions alternately disposed with said convex portions along a circular line.

11. The engine with an oil pump according to claim 10, wherein said convex portions of said first joint member are received in respective ones of said concave portions of said second joint member, and said convex portions of said second joint member are received in respective ones of said concave portions of said first joint member.

12. The engine with an oil pump according to claim 10, wherein said convex portions of said first joint member each include a top face located between said inclined face and said vertical face, and said convex portions of said second joint member each include a top face located between said inclined face and said vertical face.

13. The engine with an oil pump according to claim 11, wherein said inclined faces of said convex portions of said first joint member are positioned next to said inclined faces of said convex portions of said second joint member when said convex portions of said first joint member are received in respective ones of said concave portions of said second joint member.

14. The engine with an oil pump according to claim 13, wherein said vertical faces of said convex portions of said first joint member are positioned next to said vertical faces of said convex portions of said second joint member when said convex portions of said first joint member are received in respective ones of said concave portions of said second joint member.

15. The engine with an oil pump according to claim 9, wherein said engine includes a front cover, and said oil pump includes a casing integrally formed with said front cover.

16. The engine with an oil pump according to claim 9, wherein said oil pump includes an oil supply pump and an oil recovery pump, and said pump shaft is common to both said oil supply pump and said oil recovery pump.

17. The engine with an oil pump according to claim 16, wherein said oil supply pump includes a casing having a wall member, said wall member forming a barrier between said oil supply pump and said oil recovery pump.

18. The engine with an oil pump according to claim 16, wherein said oil supply pump includes a casing having a wall member, said wall member also forming part of a casing of said oil recovery pump.

19. The engine with an oil pump according to claim 9, wherein said oil pump includes an oil supply pump and an oil recovery pump, and said pump shaft is common to both said oil supply pump and said oil recovery pump, said engine includes a front cover, said oil recovery pump includes a casing integrally formed with said front cover, said oil supply pump includes a casing having a wall member, said wall member forming a barrier between said oil supply pump and said oil recovery pump.

20. The engine with an oil pump according to claim 9, further comprising an oil tank located directly above said oil pump, and at least one pipe fluidly interconnecting said oil tank with said oil pump.

21. An engine with an oil pump comprising:

an oil pump disposed on an extension line of a crankshaft of said engine;

a first joint member provided at an end portion of said crankshaft; and a second joint member provided at an end portion of a shaft of said oil pump, said joint members being coupled to each other on the same axial line within a cover of said engine, wherein the joining portions of both of said joint members are formed with concave and convex portions, and faces of said convex portions which oppose driving transmission faces of said convex portions are formed as inclined faces for guiding said convex portions of the opposing joint member together, and wherein said oil pump includes an oil supply pump and an oil recovery pump which are both driven to rotate by said crankshaft.

22. An engine with an oil pump comprising:

an engine having a crankshaft;

an oil pump having a pump shaft, said pump shaft and said crankshaft being rotatable about a same axis of rotation; and a coupling device for connecting said crankshaft to said pump shaft, said coupling device including:

a first joint member attached to an end of said crankshaft; and a second joint member attached to an end of said pump shaft, wherein said first joint member is engaged with said second joint member to transmit rotation from said crankshaft to said pump shaft, and wherein said oil pump includes an oil supply pump and an oil recovery pump, and said pump shaft is common to both said oil supply pump and said oil recovery pump.

23. The engine with an oil pump according to claim 22, wherein said oil supply pump includes a casing having a wall member, said wall member forming a barrier between said oil supply pump and said oil recovery pump.

24. The engine with an oil pump according to claim 22, wherein said oil supply pump includes a casing having a wall member, said wall member also forming part of a casing of said oil recovery pump.

25. The engine with an oil pump according to claim 22, wherein said oil pump includes an oil supply pump and an oil recovery pump, and said pump shaft is common to both said oil supply pump and said oil recovery pump.

26. The engine with an oil pump according to claim 25, wherein said engine includes a front cover, said oil recovery pump includes a casing integrally formed with said front cover, and said oil supply pump includes a casing having a wall member forming a barrier between said oil supply pump and said oil recovery pump.

* * * * *